United States Patent [19]

Hoyeck

[11] Patent Number: 4,906,134

[45] Date of Patent: Mar. 6, 1990

[54] SELF SUPPORTING FLEXIBLE WALL DAMS

[76] Inventor: Ralph H. Hoyeck, 80 Sommerville Ave., Westmount, Quebec, Canada, H3Z 1J5

[21] Appl. No.: 114,854

[22] Filed: Oct. 30, 1987

Related U.S. Application Data

[63] Continuation-in-part of Ser. No. 760,081, Jul. 29, 1985, abandoned.

[51] Int. Cl.[4] ..... E02B 7/02

[52] U.S. Cl. ..... 405/115; 405/91; 405/107

[58] Field of Search ..... 405/115, 25, 33–35, 405/53, 55, 61, 63, 91, 107, 110–116, 217; 4/487, 488, 506; 404/6

[56] References Cited

U.S. PATENT DOCUMENTS

| | | | |
|---|---|---|---|
| 495,788 | 4/1983 | Debarle | 405/115 |
| 2,609,666 | 9/1952 | Mesnager | 405/115 |
| 2,616,096 | 11/1952 | Hasselquist | 4/506 |
| 3,213,628 | 10/1965 | Serota | 405/114 X |
| 3,592,009 | 7/1971 | Glijnis | 405/53 |
| 3,798,912 | 3/1974 | Best et al. | 405/61 |
| 3,855,800 | 12/1974 | Garfinoth | 405/91 |
| 4,102,134 | 7/1978 | Marger | 405/53 |
| 4,252,461 | 2/1981 | Colamussi et al. | 405/115 |
| 4,458,456 | 7/1984 | Battle | 405/115 X |

FOREIGN PATENT DOCUMENTS

| | | | |
|---|---|---|---|
| 119013 | 9/1981 | Japan | 405/111 |
| 0020812 | 2/1983 | Japan | 405/115 |
| 618481 | 8/1978 | U.S.S.R. | 405/115 |
| 694582 | 10/1979 | U.S.S.R. | 405/115 |
| 962426 | 9/1982 | U.S.S.R. | 405/115 |
| 2039216 | 8/1980 | United Kingdom | 4/506 |
| 1604293 | 12/1981 | United Kingdom | 405/115 |

*Primary Examiner*—Dennis L. Taylor

*Attorney, Agent, or Firm*—Maritide Co. Ltd.

[57] ABSTRACT

A flexible wall dam assembly, or the like, comprising two opposite elongated flexible walls with balanced inclination towards each other, water filling the space between them and counterbalancing ties joining the upper edge of the walls. Balanced cable beams support the flexible walls and transfer their loads to each other or to the waterbed through equally balanced anchoring ties.

19 Claims, 7 Drawing Sheets

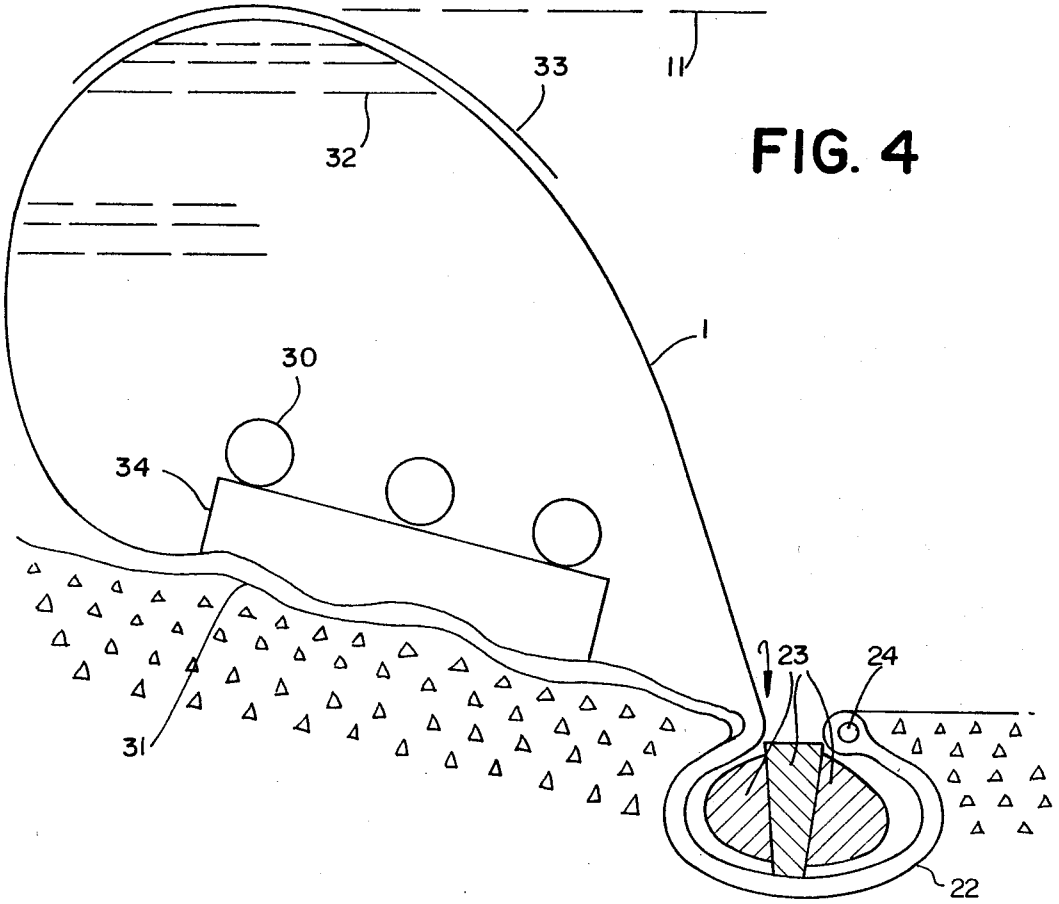
FIG. 4
FIG. 4A
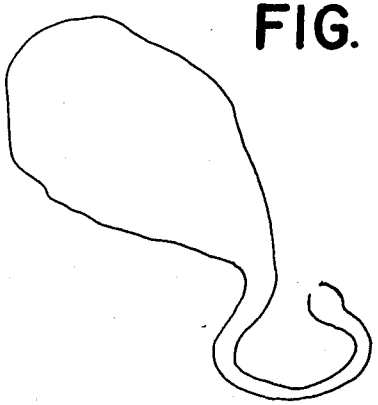
FIG. 4B
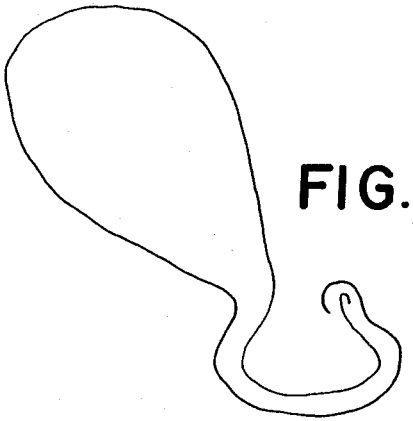

SELF SUPPORTING FLEXIBLE WALL DAMS

This application is a continuation-in-part of application Ser. No. 06/760,081, filed July 29, 1985, now abandoned.

BACKGROUND OF THE INVENTION (a) Field of the Invention

The present invention relates to a self-supporting flexible wall dam. It deals with a flexible wall dam, vertically supported by the upward vertical component of the internal water pressure acting on it and it balances and counterbalances the horizontal water pressure acting on it.

(b)Description of Prior Art

French Patent No. 495,788 issued to L. Debarle teaches a flexible membrane dam for irrigation canals consisting of a canvas or a simple flexible membrane dam with the lower edge of the said membrane buried in a trench and covered with earth as a means of anchoring. Debarle uses random anchoring ties and floats together with vertical solid posts to support the flexible membrane assembly and the downward pulling forces generated by the random anchoring ties.

U.S.S.R. Patent No. 618,481 issued to Melior describes a water level control system which consists of a float connected to a vertical sliding gate by means of a rope. With the rise of the water level the float rises and lifts up the gate allowing the water to escape thereby keeping the water level under control. The Melior Patent is based on a float using the buoyancy water pressure which is different than the vertical component of the internal water pressure acting on the retaining flexible wall.

The actual prior art is applicable to water heads from 3 to 6 ft. high, beyond which, it becomes impractical, uneconomical and gradually impossible.

For example, consider a flexible wall dam retaining a water head 33 ft. high or 10 metres with two anchoring ties at 45°, one at 5 metres high and one at the top of the flexible wall at 10 metres from-the waterbed.

The approximate stresses on a vertical strip of the flexible wall, one metre wide or 3.3 ft. and 10 metres high due to the water pressure only are the following.

The horizontal water pressure at the anchoring line is over 7 ton per linear ft. The tension stress at the intersection of the middle anchoring cable with the flexible wall is over 35 tons. The vertical downward forces resulting from the 45° anchoring cables are about 28 tons per linear metre and with the flexible wall and attachments, they would reach well over 30 tons per linear metre, which requires a continuous float of 5 metres deep by 6 metres wide, which is a costly additional installation that would require additional ties and connections with the flexible wall.

The actual material used for the flexible walls in the prior art could not stand loads of 7 tons per linear ft. at the anchoring lines. The flexible wall material available until now and used in the prior art could not stand 35 tons of tension stresses at the connection point of the middle anchoring cable and the flexible wall. The use of plain, random anchoring ties and floats to support the system becomes impractical, uneconomical and gradually impossible. In other words, it would be cheaper to build concrete dams rather than ties and floats nearly reaching the floor of the dam. The anchoring system used in the prior art, by covering the lower edge of the flexible wall with earth or gravel could in no way support 7 tons per linear ft. of horizontal water pressure, and in case bolts and nuts are used on the flexible wall, the 7 tons of tension stresses per linear ft. would tear up the flexible wall. Besides, the life span of the flexible walls, available up to date is from 20 to 30 years at the most, after which the flexible wall has to be fully or partially replaced.

For a flexible wall dam anchored under a mass of earth and for a flexible wall dam anchored through a bolt and nut system that becomes covered with rust and sediments, it would be necessary to dig up and rebuild the whole anchoring system every time the flexible wall has to be repaired or replaced.

The aforementioned example provides that the technology used in the prior art, either singly or in combination, and the material available until now for the flexible walls used in the prior art, are only good for low water heads of 3 to 6 ft. high for irrigation canals or the like, beyond which the prior art becomes impractical, uneconomical and gradually impossible.

A new technology to manufacture the required cross reinforced flexible walls and a new complicated technology for splicing said flexible walls are therefore required to provide a new type of flexible wall. It is also required to balance the supports and the anchoring ties of the flexible wall dams to avoid the production of downward vertical forces by the anchoring tie.

It is also required to counterbalance the horizontal forces acting on the upstream and downstream flexible walls to create an independent, continuous self-supporting flexible wall dam assembly that stands up by itself without the use of external vertical supports, such as floats, vertical posts, supporting cables or the like.

It is also required to provide a new anchoring system that could insure a tight and firm grip between the flexible wall and the watered without perforation of the flexible wall, with the least material possible and in a simple system easy to install and dismantle, with the minimum underwater operation possible.

According to the invention there is provided a cross reinforced, cross spliced self-supporting flexible wall dam which is vertically supported by the upward vertical component of the internal water pressure acting on it, and the horizontal water pressure acting on the flexible walls is balanced and counterbalanced to create a self-supporting assembly which uses a restricted changeable anchoring system firmly secured to the waterbed.

It is an object of the present invention to provide a self-supporting flexible wall dam and the like for restraining the flow of water which comprises two oppositely disposed cross reinforced flexible walls, water filling the space therebetween, their lower edges being firmly secured to the waterbed with a restricted changeable system, and their upper edges being inclined towards each other, with balanced inclination. The walls are reinforced and interconnected with counterbalancing ties to counterbalance the horizontal forces of the varying water pressure acting on the flexible walls while the vertical component of the internal water pressure supports the flexible walls and their attachments.

It is another object of the invention to provide a flexible wall dam with balanced horizontal cable beams supporting the flexible wall and transferring their loads to the waterbed through balanced anchoring ties, avoiding the generation of downward forces on the flexible wall.

It is another object of the invention to provide a flexible wall dam having a downstream flexible wall wherein the horizontal counterbalancing ties are connected at the top edge of the flexible wall, to points upstream which are at the same level or higher.

It is another object of the present invention to provide a flexible wall dam having a downstream flexible wall wherein the horizontal counterbalancing ties are connected at the top edge of the flexible wall, and the anchoring ties below the counterbalancing ties are connected to points upstream at the same level or higher.

It is another object of the invention to provide a flexible wall dam solid hinging anchoring ties with solid spacers therebetween, to allow the flexible dam to open and close in a pattern similar to the hood of a baby carriage.

It is another object of the present invention to provide a water retaining flexible wall assembly wherein the flexible wall is folded around horizontally, with a cable beam reinforcement, to form a closed, truncated cone like structure, resting on its larger base, filled with water, vertically supported by the water filling it, and also being provided with counterbalancing rings.

It is another object of the present invention to provide a flexible wall dam wherein the top edge of the flexible wall is folded down and anchored to the waterbed, and is inflated with water to form a closed envelope capable of retaining a water head on one side.

It is another object of the present invention to provide a flexible wall envelope holding internal stagnant water above freezing temperature, by means of flowing water circulating through separate conduits passing through the stagnant water.

It is another object of the present invention to provide a flexible wall dam having an anchoring system consisting of a solid transversal "C" shaped cross section channel, embedded in the waterbed with its narrow opening horizontally disposed and flush with the waterbed surface where the lower edge of the flexible wall is laid inside the channel, beyond which, are inserted, longitudinal wedging blocks that are forced to interlock and squeeze the flexible wall inside the channel.

SUMMARY OF THE INVENTION

The present invention relates to a self-supporting flexible wall dam assembly, or the like, for restraining the flow of water, comprising in combination, two flexible walls oppositely disposed on a waterbed, means to enable water to fill space between said oppositely disposed flexible walls, said flexible walls each having upper and lower edges, means for sealingly securing said lower edges to said waterbed, each said wall being formed with at least one arcuate portion thereby enabling said flexible walls to be inclined towards one another, means defining counterbalancing ties to interconnect the upper edges of said oppositely disposed flexible walls, said water in said space having an internal water pressure defining a vertical component and a horizontal component acting against the at least one arcuate portion of said flexible wall, transversal tie means connecting both said flexible walls to said waterbed, so that said vertical components of said internal water pressure hold said flexible walls in upward position, while the horizontal components of said internal water pressure are counterbalanced by said transversal tie means resulting in a self-supporting flexible wall dam assembly, capable of holding a water head on the upstream side slightly lower than the internal water head retained in between the two oppositely disposed flexible walls.

BRIEF DESCRIPTION OF DRAWINGS

FIG. 4 shows a section view of the flexible wall shown on FIG. 2, folded edge to edge and anchored to the waterbed.

FIG. 4A shows a totally closed-in flexible wall envelope anchored to the waterbed.

FIG. 4B shows a flexible wall enveloped with free ends folded and anchored to the waterbed.

DESCRIPTION OF PREFERRED EMBODIMENTS

Figure 1:
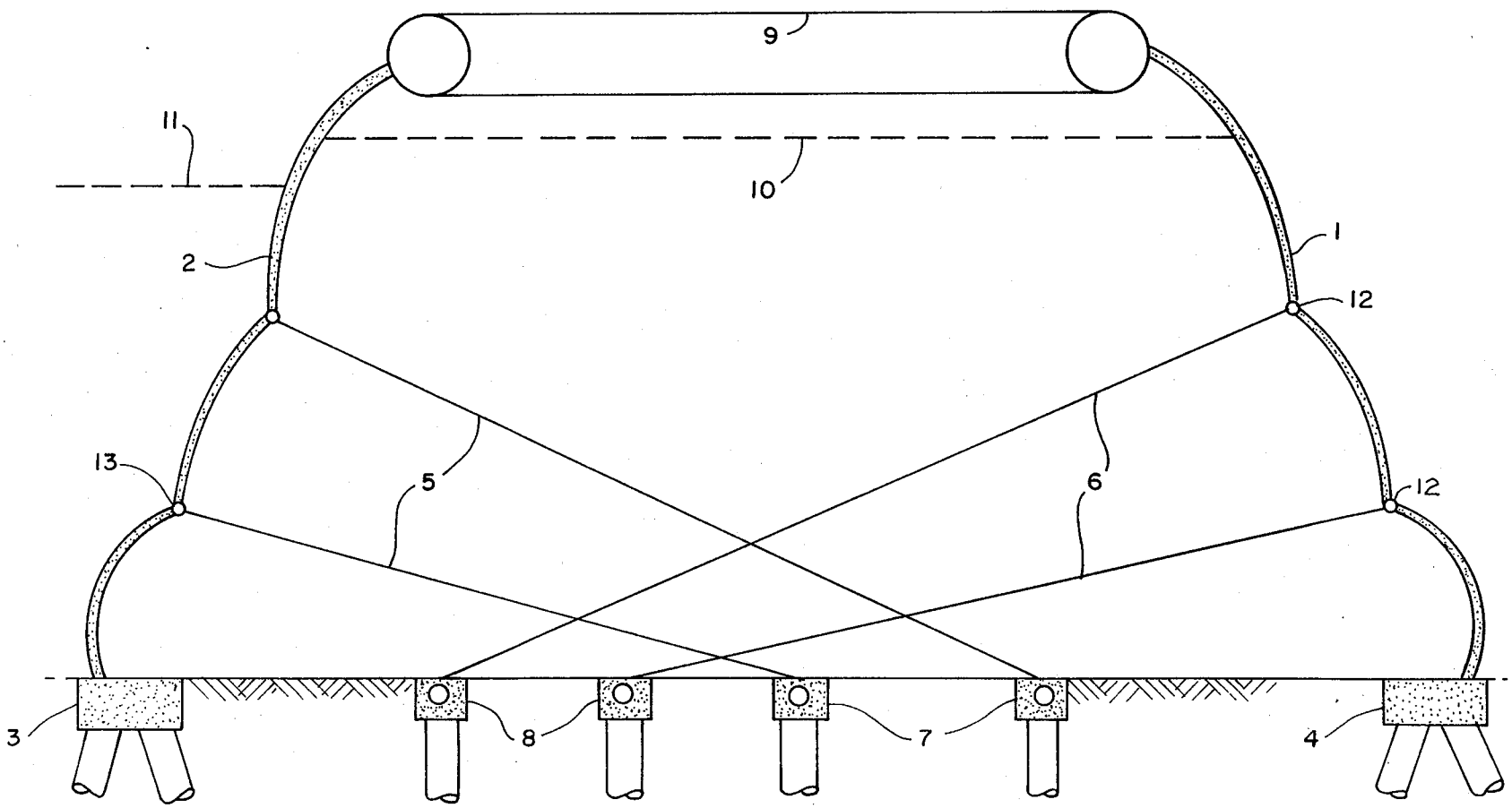
FIG. 1 shows a cross section of an upstanding water wall contained between two opposite flexible walls and retaining on one side a water head slightly lower than the contained water wall.

FIG. 1 shows a flexible wall dam assembly consisting of 2 opposite flexible walls 1, 2, with water filling the space therebetween, firmly secured at their lower edges to the waterbed, along lines 3, 4, with their upper edges inclined toward each other to balance the water pressure acting on the upstream and downstream flexible walls and counterbalanced at different levels by tying means 9, the flexible walls are supported with balanced cable beams 12, 3, transferring their loads through balanced anchoring ties 5, 6, anchored to waterbed platforms 7, 8.

The flexible walls 1, 2, are cross reinforced, with high tensile strength reinforcement, and cross spliced to resist the high water head water pressure acting on them.

The flexible walls are anchored to the waterbed by means of wedging blocks squeezing the flexible walls inside a "C" shaped channel formed in the waterbed as further described in detail with reference to FIG. 6.

The opposite flexible walls 1, 2, are substantially inclined toward each other to counterbalance each other and to counteract the external water head on the flexible dam assembly, including the effect of the external water head on the balanced cable beams and the balanced anchoring ties, taking into account whether the dam is destined to be always full or periodically empty, etc.

To counterbalance the internal water pressure acting on the opposite flexible walls to push them away from each other, the flexible walls are provided with interconnecting means 9 at different levels, to keep them at certain distances from each other.

The counterbalancing ties are connected to the flexible walls through transversal cables reinforcing the flexible walls.

Furthermore the flexible walls 1, 2, are supported with balanced cable beams 12, 13, that transfer their loads to the waterbed through balanced ties 5, 6.

The balanced cable beams and their anchoring ties are positioned in a way to have the direction of the resultant forces of the internal water pressure acting on the flexible walls above and below the anchoring ties, to be parallel to the direction of the anchoring ties themselves, avoiding the creation of downward vertical forces due to the anchoring ties.

In certain cases the cable beams 12, 13, transfer their loads through counterbalancing connections 9. In such cases the balanced anchoring ties 5, 6, would be acting like stabilizing ties preventing the whole assembly from swaying one way or the other.

Similar external stabilizing ties are installed in certain cases like guy ropes on the opposite sides of the flexible walls.

Tests on a prototype of the aforementioned flexible wall assembly using an upstanding mass of water resembling an upstanding, substantially trapezoidal cross section water wall retained in between opposite flexible walls as previously described showed that the so described flexible wall/water wall assembly is capable of retaining on one side thereof a water head slightly lower than the water head retained inside the opposite flexible walls. Also, the factors, namely: the degree of inclination of each of the flexible walls towards the other; the distance between the anchoring lines of the opposite flexible walls; the stiffness of the flexible walls through their interconnections, etc. For the same size of flexible wall materials, the height of the internal water head retained between the flexible walls could be increased by increasing the number of cable beam supports with their counterbalancing ties.

With the increasing height of the water head, the counterbalancing ties and the anchoring ties below, can be constructed as continuous strips one next to the other and further converted into a continuous flexible wall, thereby converting the whole assembly into a downstream side, superimposed closed envelopes similar to that shown in FIG. 4, FIG. 5, with multi anchoring lines of the type shown in FIG. 6. Furthermore for practical reasons, use is made of separate independent envelopes superimposed over each other and in certain cases sharing common anchoring lines between adjacent envelopes.

Figure 2:
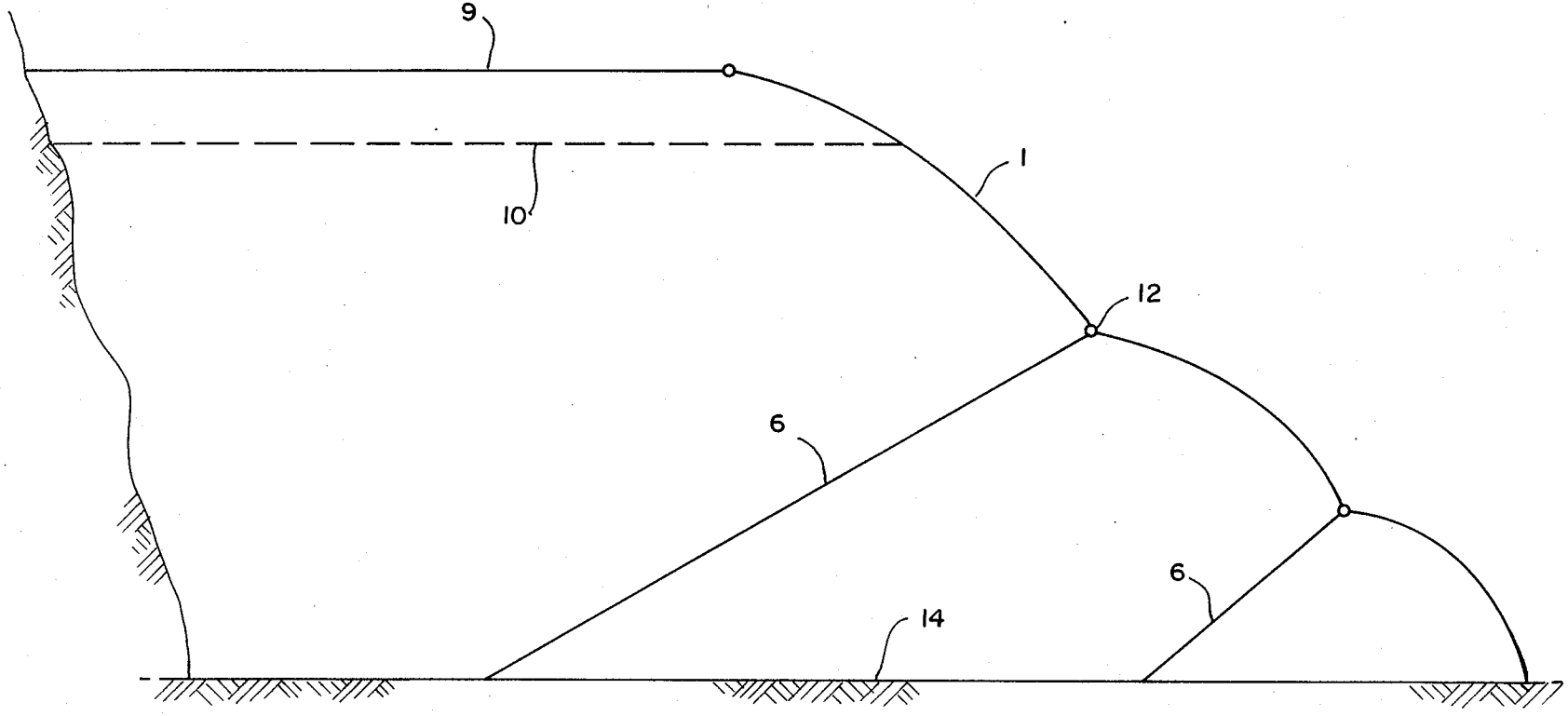
FIG. 2 shows the right half of the cross-section shown in FIG. 1.
Figure 2B:
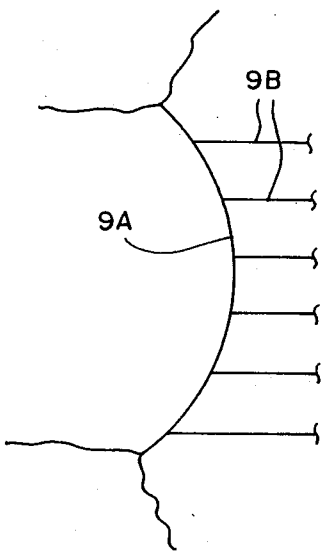
FIG. 2B is a plan view of the suspended cables supporting the top edge of the flexible wall.

FIG. 2 shows a flexible wall dam 1, representing the downstream flexible wall of the flexible wall dam assembly shown in FIG. 1, having the counterbalancing ties 9, anchored to holding points upstream at the same height or higher than the retained water level thereby avoiding the creation of downward resultant forces on the flexible wall.

For low water head dams the flexible wall 1 consists of a simple flexible wall dam anchored at its lower edge to the waterbed, sustantially inclined upstream and connected at its upper edge with horizontal or upward ties to holding points upstream.

For higher water heads the flexible wall is supported at its back with balanced cable beams 12, at intermediate levels, transferring their loads, by means of balanced ties 6, to anchoring points upstream, on the waterbed, and wherever possible, to higher points at the opposite sides of the water course, which fact reduces the downward forces acting on the waterbed.

The positions of the cable beams 12 and the direction of their ties 6, is balanced so that the direction of the resultant forces of the water pressure acting on the upper and lower curves above and below the ties pass parallel to the anchoring ties thereby avoiding the creation of downward forces due to the ties, leaving residual internal water forces, acting at the top half curve of the flexible wall which internal forces could be balanced with horizontal or upward ties 9, connecting the upper edge of the flexible wall to holding points upstream.

Such flexible wall dams are applicable generally for narrow water courses in valleys where it is possible to connect the upper edge of the flexible wall with horizontal or upward ties to the opposite sides of the water course.

Figure 2A:
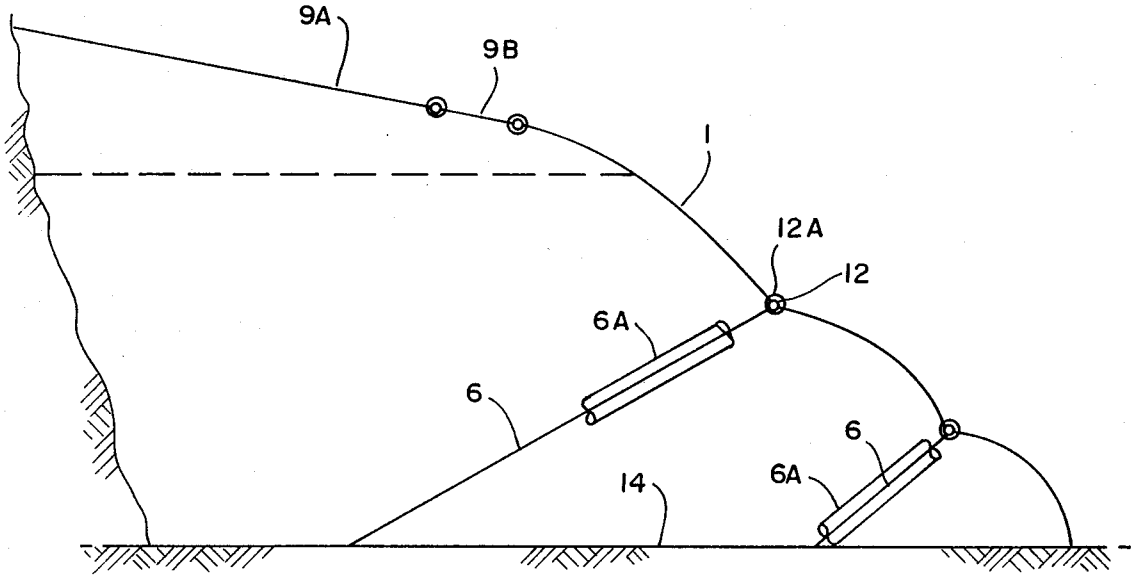
FIG. 2A is the same as FIG. 2 with solid anchoring ties replacing the flexible ties, and suspended cables supporting the u of the flexible wall.

FIG. 2A shows a flexible wall water lock having basically the same design as the flexible wall shown in FIG. 2 and having the anchoring ties 6 provided with solid spacers 6A, or made originally of solid hinging units and, in certain cases, telescopic, and the cable beams 12, either solid or provided with solid spacers 12A between the anchoring ties to allow the flexible wall water lock to open and close in a baby carriage hood pattern.

The use of solid hinging ties and solid spacers is intended to guide the flexible wall to open and close in a pattern similar to the hood of a baby carriage, cutting its way through the mass of water in a narrow line, otherwise the flexible wall upon closing, would fall flat to the floor of the waterbed and to lift it up in a certain speed, the whole mass of water would have to be lifted over it.

The upper edge of the flexible wall is supported by a series of horizontal or upward ties 9B, attached to a main supporting, arching cable 9A, anchored at both ends at the opposite sides of the water course, and provided with mechanisms allowing it to be released or pulled in as needed, resulting in an assembly similar to an inclined suspended bridge pattern with the additional pull in/out mechanism.

To build up a water head in the lock, the suspended cable 9A, is pulled in, lifting with it the upper edge of the flexible wall water lock which pulls up the whole flexible wall, cutting its way along a narrow line, while opening in a baby carriage hood pattern, and consequently, a water head builds up at the upstream side of the water lock.

Figure 3B:
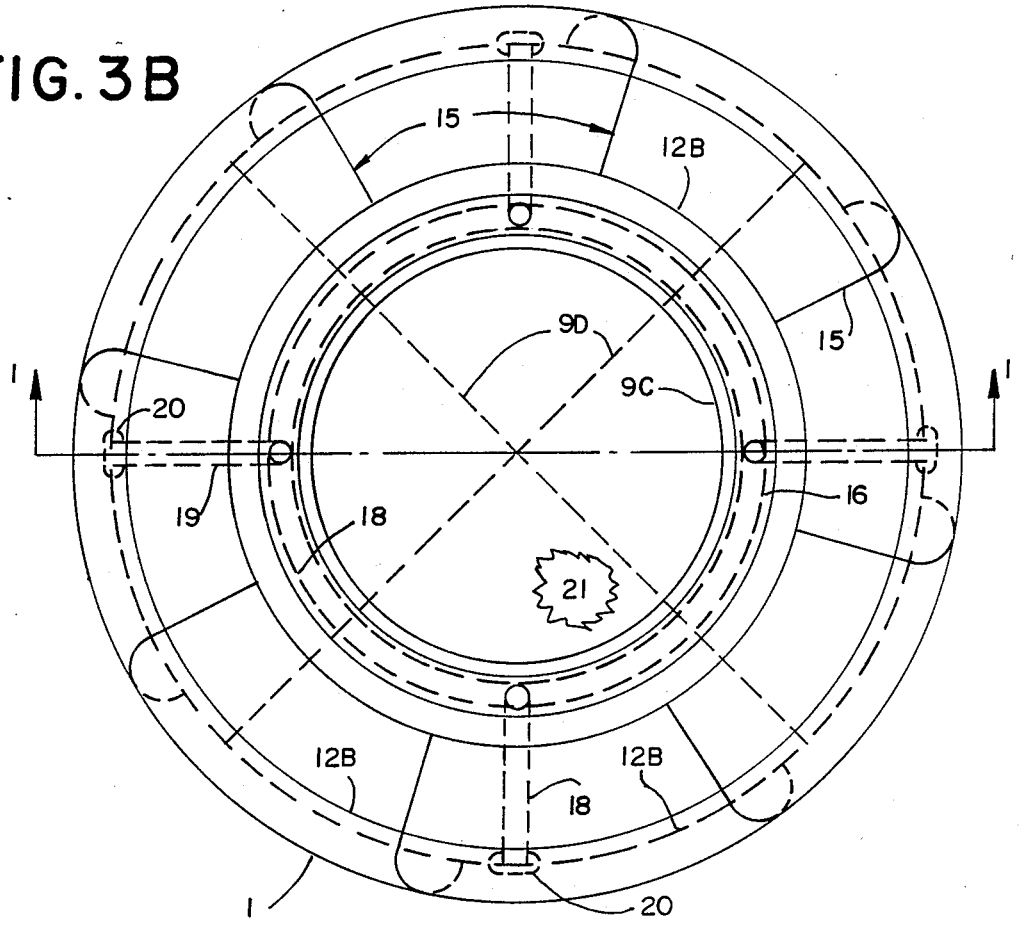
FIG. 3B is a cross section of FIG. 3A.
Figure 3A:
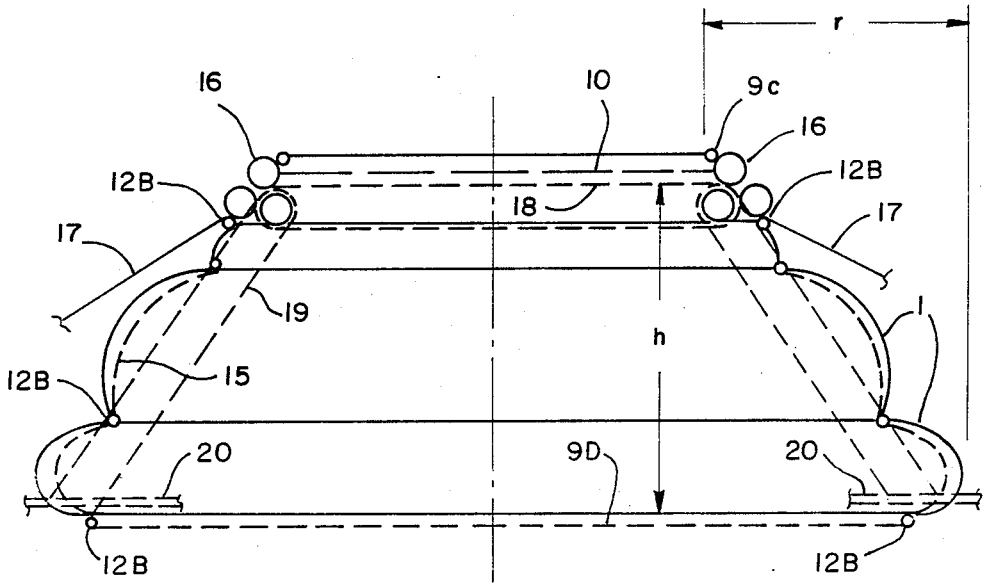
FIG. 3A shows a plan view of an open top water column of a truncated cone shape contained in a continuous closed-in-all-around flexible wall skin supported with flexible reinforcing rings.

FIG. 3 shows a plan view and FIG. 3A shows a cross section of an upstanding circular flexible wall 1, retaining a mass of water in a truncated cone like pattern referred to hereinafter as a water column.

The retaining flexible wall 1 is basically the same as the flexible wall 1, shown in FIG. 2, folded in a circular shape and sealed edge to edge, resulting in an upstanding cone shape structure 1, retaining inside it, an upstanding water column to a water level 10 that exerts outward pressure in all directions acting perpendicularly to the direction of the retaining flexible wall where the upward vertical component of the internal water forces support the retaining flexible wall.

The internal horizontal forces exerted by the water column on the retaining flexible wall 1, are counterbalanced by the reinforcement of the flexible wall and by the upper ring 9C, joining the upper edge of the flexible wall 1.

For taller water column assemblies the flexible wall 1 is supported by a grid of rings 12B, supporting the back of the flexible wall at intermediate levels between the waterbed and the surface of the water, with means to keep the rings in place such as transversal ties 15.

The use of the reinforcing rings results in a taller water column structure with the same flexible wall materials used.

To reduce the size of the reinforcing rings, use is made of counterbalancing transversal ties 9D, connecting the opposite sides of the rings to each other and to the base of the water column which fact also stiffens the water column assembly and prevents it from swaying one way or the other.

The use of external ties in the guy rope pattern 17 would also stiffen the water column assembly and prevent it from swaying.

In certain cases, the lower periphery of the flexible wall 1 is joined together with a flexible wall base 21, forming the floor of the water column assembly resulting in a water tight independent, portable flexible wall unit that could be emptied and transported from place to place.

It will be useful to add light buoyant 16, at the top edge of the flexible wall to prevent it from sagging into the water under occasional external pressure, due to the reduced water pressure at the surface of the water.

Besides, the installation of 3 minimum radial solid legs 13, with base plates 20, on the periphery of the water column assembly would help to support the flexible wall structure during the filling operation until the water head inside the structure is high enough to support the structure.

If the flexible wall circular structure is used as a reservoir to store valatile hydro-carbon products or the like, the reservoir is provided with an oversized covering membrane consisting of a flexible, impermeable, inextensible membrane tightly connected to the upper periphery of the circular reservoir and dropping inside the reservoir as an inverted balloon following the surface of the liquid, serving in one way to prevent the formation of hazardous gases at the surface of the liquid and in another way to prevent the escaping of gases if any is formed at the surface of the liquids.

Weights are added in certain cases over the flexible cover to help prevent the formation of gases at the surface of the covered liquids.

At the same time, provision is made to drain the rain water accumulating inside the inverted balloon to prevent the seepage of water into the stored hydro carbon products.

Figure 5:
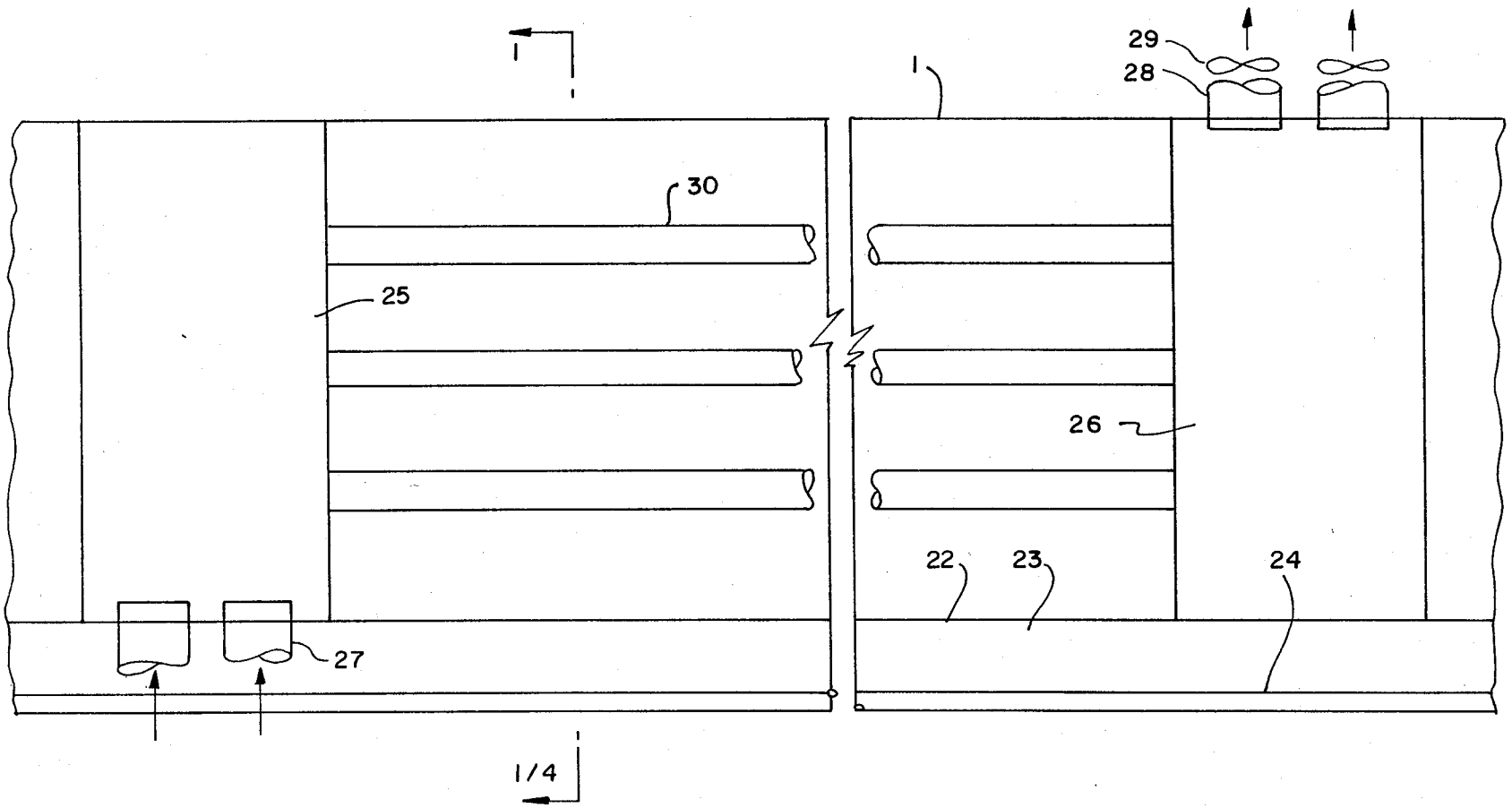
FIG. 5 shows a plan view of the flexible wall envelope shown in FIG. 4.

FIG. 4 shows the cross section and FIG. 5 shows the plan view of a water filled flexible wall envelope 1, using basically the flexible wall 1, shown in FIG. 2, with the upper edge folded down and anchored to the waterbed resulting in the closed envelope shown in FIG. 4 and FIG. 5.

Similar results could be obtained by joining the upper edges of the flexible walls shown in FIG. 1.

In case the water inflated envelope has to be deflated in sub-zero temperatures to allow the passage of jamming icebergs or the like, the envelopes are provided with internal tubular conduits 30, distributed through the stagnant water 32, with internal water circulating through said conduits to prevent the surrounding stagnant water from freezing under sub-zero temperatures.

The circulating water is taken from the flowing water of the river under the frozen surface, which flowing water is naturally over zero temperature and when circulated through the pipes inside the closed envelopes it liberates enough warmth combined with the friction factor, to prevent the stagnant water inside the envelope from freezing under sub-zero temperature.

To give a better stability to the water filled tubular water barrier, the base upon which the water barrier rests, is made inclined towards the upstream direction, in a way to have the direction of the resultant forces of the water pressure, acting on the water filled envelope, pass through the middle third or as near as possible to the middle third of the base upon which the envelope rests.

The water course could be divided into spans separated by solid piers 25, 26, which serve to connect the opposite ends of the flexible envelopes. At the same time such piers could be the water inlet and outlet to the warming conduits 30, with possible installation of electric generating turbines 29, at the water outlet 28.

Figure 6:
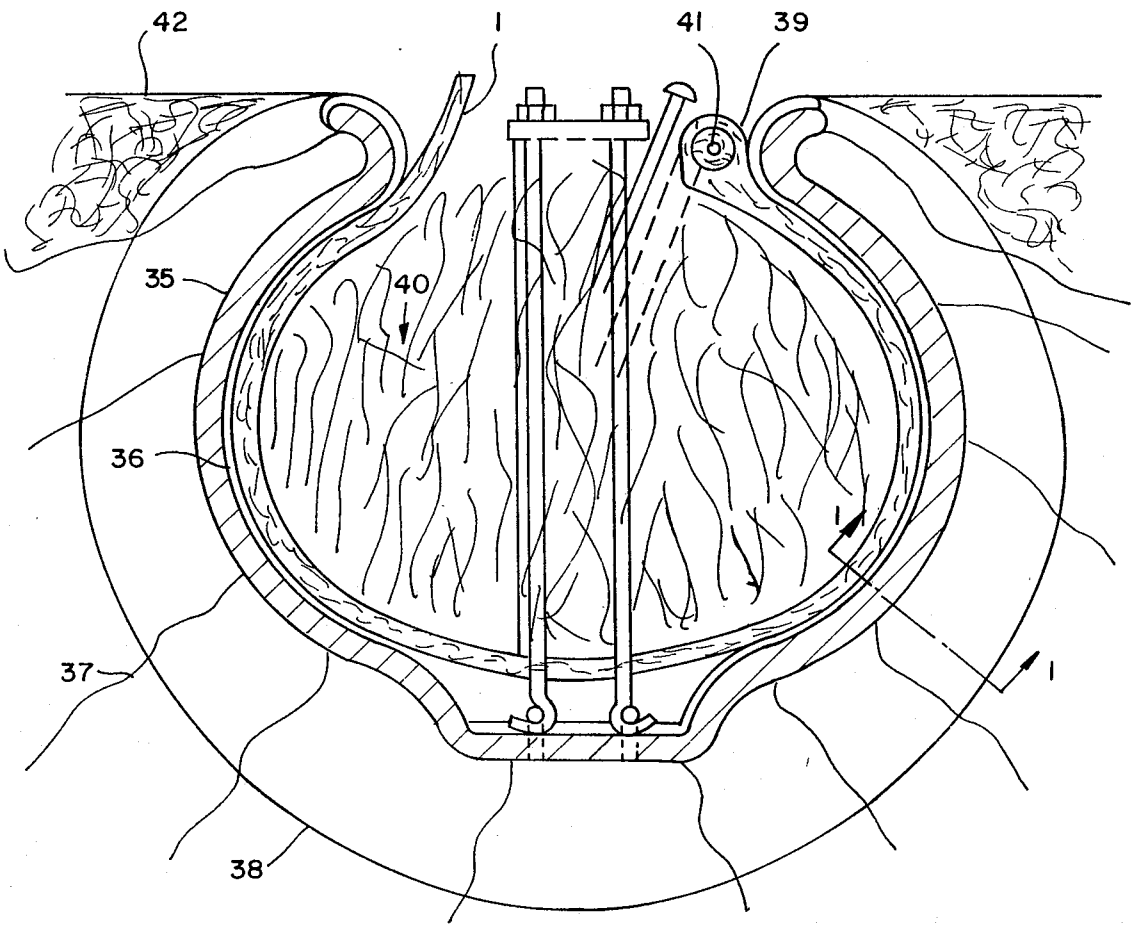
FIG. 6 shows an anchoring system connecting the flexible wall to the waterbed.
Figure 6A:
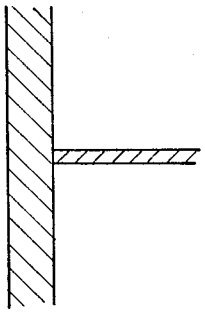
FIG. 6A is a cross section of FIG. 6.

Both the opposite longitudinal ends of the flexible envelope 1 are anchored to the waterbed along separate anchoring lines in the manner shown in FIG. 6.

Furthermore to increase the anchorage capacity between the flexible envelope and the waterbed, the floor of the waterbed under the flexible envelope is provided with transversal keys consisting of shallow channels 31, that increase the grip between the flexible envelope and the waterbed.

In addition, to prevent icebergs from shearing the flexible wall envelope the latter is shielded with a hard cover 33, covering the upper part of the envelope.

Besides, since the flexible envelope is destined to be inflated and deflated periodically, it is provided with internal hinging mechanisms 34, inside the rubberized cover to prevent the fatigue of the internal reinforcements of the flexible wall envelope.

FIG. 4A shows a closed in tubular envelope flattened at one edge and anchored to the waterbed.

FIG. 4B shows an envelope made of an open flexible wall folded edge to edge and anchored to the waterbed.

The anchoring assembly comprising the channel 22, the wedging blocks 23 and the end block 24 are similar to items 35, 40, 41 in FIG. 6.

FIG. 6 shows an anchoring system used to anchor the flexible wall 1 to the waterbed floor 42, consisting of a transversal longitudinal "C" shape channel 35, with its opening, horizontal, flush with the concrete surface of the waterbed. The channel is internally lined with corrosion protective lining 36, externally reinforced with flanges 38, embedded in a mass of concrete 42 and anchored to said mass of concrete by means of welded dowels 37.

The flexible wall 1 is inserted inside the channel, over which are inserted longitudinal wedging blocks 40, which are forced to interlock and squeeze the flexible wall inside the channel.

To prevent the end of the flexible wall from slipping out, the end of the flexible wall is provided with a loop through which, round longitudinal blocks 41, are inserted to enlarge the cross section of the tail of said flexible wall and prevent it from slipping out.

I claim:

1. A self-supporting flexible wall dam assembly, or the like, for restraining the flow of water, comprising in combination, two flexible walls oppositely disposed on a waterbed, means to enable water to fill space between said oppositely disposed flexible walls, said flexible walls each having upper and lower edges, means for sealingly securing said lower edges to said waterbed, each said wall being formed with at least one arcuate portion hereby enabling said flexible walls to be inclined towards one another, means defining counterbalancing ties to inter connect the upper edges of said oppositely disposed flexible walls, said water in said space having an internal water pressure defining a vertical component and a horizontal component acting against the at least one arcuate portion of said flexible wall, transversal tie means connecting both said flexible walls to said waterbed, so that said vertical components of said internal water pressure hold said flexible walls in upward position while the horizontal components of said internal water pressure are counterbalanced by said transversal tie means resulting in a self-supporting flexible wall dam assembly, capable of holding a water head on the upstream side slightly lower than the internal water head retained in between the two oppositely disposed flexible walls.

2. A self-supporting flexible wall dam assembly as in claim 1, wherein said flexible walls are formed of a plurality of arcuate portions, an arcuate portion being connected to an adjacent arcuate portion by means of an apex, said transversal tie means being connected to said flexible walls at said apices.

3. A self-supporting flexible wall dam assembly according to claim 2 wherein said transversal tie means comprise balanced cable beams provided at said apices, at intermediate levels along said walls to support the back of said flexible walls, and means enabling to transfer loads of said flexible walls, supported by each balanced cable beam, to opposite cable beams, at different elevations of the opposite flexible wall.

4. A self-supporting flexible wall dam assembly according to claim 3 using balanced anchoring ties connecting said balanced cable beams to said waterbed, thereby avoiding the creation of downward forces by said anchoring ties.

5. A self-supporting wall dam assembly according to claim 3, which comprises guy ropes mounted on opposite sides of said flexible walls to constitute lateral stiffeners therefore.

6. A self-supporting wall dam, or the like, for use in restraining the flow of water, comprising in combination, an upstanding impermeable inextendible flexible wall, said wall having reinforced upper and lower edges, means for positively and substantially sealingly securing said lower edge to a waterbed, said wall being formed with at least one arcuate portion and being inclined against the upstream direction of the water it retains, using the vertical components of the water pressure exerted by the retained water, acting on the arcuate retaining wall to lift said retaining wall, with additional horizontal or upward ties at the upper edge, of the said flexible wall, to counterbalance the residual horizontal components of the water pressure exerted by the retained water at the upper half of the upper arch of the arcuate flexible wall, which horizontal residual forces were left unbalanced, where the remaining horizontal and vertical forces in between, the waterbed and the middle line of the upper curvature of the flexible wall are counterbalanced, by the lower edge of the anchored retaining flexible wall and by the balanced anchoring ties transferring the loads from the flexible wall to the waterbed or the like.

7. A self-supporting flexible wall dam as in claim 6, using cable beams to support the flexible wall at predetermined intermediate levels between the waterbed and the surface of the water, and anchoring ties transferring the loads from the said cable beams to the waterbed, the assembly of the said cable beams and the said anchoring ties being spaced and balanced to have the resultant of the water pressure forces acting on the flexible wall, above and below the anchoring ties, pass substantially parallel to the direction of the said anchoring ties so avoiding the creation of downward forces acting on the flexible wall.

8. A flexible wall dam assembly as in claim 7, for use as a waterlock, destined to open and close frequently and with the minimum time and energy possible, comprising solid and telescopic anchoring ties with solid spacers there between, enabling the flexible wall to open and close in an arcuate pattern, cutting its way in a narrow line across the mass of water, so reducing the water resistance to the movement of the said flexible wall, and the upper edge of the flexible wall being reinforced and connected with a plurality of ties to a common supporting cable, bridging between the opposite sides of the water course with mechanisms to pull in or release said cable, to lift up the said flexible wall and close the waterway or to let it fall down to the waterbed leaving the said waterway fully open.

9. A self-supporting water retaining flexible wall structure, as in claim 6, rolled around horizontally in a circle, with both upright edges tightly connected to each other resulting in a closed in structure of a truncated cone shape pattern resting on its larger base, and retaining inside it a water column of the same pattern, the resulting unit being a self-supporting structure with a self-supporting flexible wall, the vertical components of the resultant water pressure acting on the flexible wall help lift up said flexible wall, and the horizontal components of the water pressure are counterbalanced by the circular flexible wall itself and by means of reinforcing rings supporting the said flexible wall at different levels, with a top ring reinforcing the top edge of the flexible wall and counter balancing the residual horizontal forces at the upper half of the top arch of the flexible wall.

10. A self-supporting water retaining flexible wall structure as in claim 9, comprising reinforcing rings, supporting the flexible wall at predetermined intermediate levels in between the waterbed and the surface of the water, calculated to allow balanced anchoring ties connecting the said reinforcing rings to the waterbed, means to hold the reinforcing rings in place and provisions for transversal ties to interconnect opposite points of said reinforcing rings to each other, together with internal or external anchoring and stabilizing ties arranged in a guy rope pattern as lateral stiffeners to the resulting structure.

11. A self-supporting, water-retaining, flexible wall conic structure as in claim 10, wherein the lower edge of the flexible wall is tightly and firmly joined with a circular flexible wall, forming the floor of the said truncated cone, and resulting in an independent portable flexible liquid reservoir.

12. A self-supporting, water retaining, flexible wall circular structure as in claim 11, comprising buoyants below the water surface at the top edge of the flexible structure to prevent said top edge from dipping through the water due to casual external pressure, and means to prevent said buoyants from overturning and losing their buoyancy.

13. A self-supporting, liquid-retaining, flexible wall circular structure, as in claim 11, used for storing volatile liquids, comprising a flexible impermeable, inextensible oversized membrane rooftop tightly connected to the upper edge of the said circular structure and sagging down as an inverted baloon inside the circular truncated cone structure, weights being provided over said membrane to prevent it from easily bubbling up, and a drainage means to drain out any rain water accumulated over said flexible membrane rooftop.

14. A self-supporting flexible wall dam, as in claim 6, for use in restraining the flow of water, having the top edge of the flexible wall, folded down and anchored to the waterbed, along an anchoring line, located upstream from the original anchoring line, resulting in a water filled envelope retaining in front of it, a water head, equal to its height, said flexible envelope rests on a concrete base, inclined against the upstream direction, with longitudinal grooves made as keys in the concrete base to create a better grip between the concrete base and the flexible envelope, with the whole assembly positioned so that the resultant forces of the water pressure acting on the flexible envelope and its concrete support, pass through the middle third of the base of the said support.

15. A self-supporting flexible wall dam, made of a closed envelope as in claim 14, destined to be water inflated and deflated under sub-zero temperature, comprising internal conduits distributed inside the stagnant water, filling said envelope, with continuous water circulation, through the said conduits, from the unfrozen water flowing at the bottom of the water course, which flowing water liberates enough warmth, which together with the skin friction factor prevent the surrounding stagnant water inside the envelope, from freezing under sub-zero temperature.

16. A self-supporting flexible wall dam assembly, as in claim 1, for use in restraining the flow of water, with the top edges of the opposite flexible walls, tightly and firmly joined together to form a continuous enclosed envelope, and with an additional impermeable membrane laid flat on the waterbed inside the resulting envelope and anchored at its opposite edges along the same anchoring lines used to anchor the opposite flexible walls forming the envelope, resulting in an all around tight flexible envelope with double anchoring lines to the waterbed.

17. A self-supporting flexible wall dam, as in claim 15 or 16 combines, destined to be water inflated and deflated under sub-zero temperatures, comprising an all around closed in flexible impermeable membrane with internal water circulating conduits to prevent the stagnant water filling the envelope from freezing under sub-zero temperature.

18. A self-supporting water-retaining flexible wall assembly, as in claim 1, which comprises a transversal longitudinal channel of a "C" shaped cross section configuration to secure the lower edge of the flexible wall to the waterbed, said longitudinal channel being laid flat across the waterbed with its opening flush with the floor level of the waterbed and with the lower edge of the flexible wall laid as an internal lining inside said channel, longitudinal wedging blocks being introduced in mouth pieces over said channel and forced to interlock and squeeze said flexible wall inside said channel and the tail of the flexible wall ending as a loop through which round longitudinal blocks are inserted to enlarge the cross section of the end tail of the flexible wall and prevent it from slipping out.

19. A self-supporting flexible wall dam assembly, as in claim 7, used for high water heads, with the upper edge of the flexible wall bent down and anchored to the waterbed, using anchoring means consisting of continuous impermeable, inextendible flexible walls, tightly connected to the main water retaining flexible wall, and tightly anchored along continuous anchoring lines to the waterbed, resulting in a plurality of water tight envelopes anchored to the waterbed through a plurality of parallel anchoring lines, one ahead of the other, and for practical reasons, to save the costly connections between the anchoring ties and the water retaining flexible wall, use is made of separate flat flexible walls folded along their longitudinal edges, superimposed and anchored to the waterbed along a plurality of parallel anchoring lines one ahead of the other, with the upper edge of a lower envelope sharing the same anchoring line with the lower edge of the adjacent superimposed envelope, resulting in a plurality of independent water inflated superimposed envelopes sharing a plurality of common parallel anchoring lines one ahead of the other.

* * * * *